US011663854B2

(12) United States Patent
Lakovic

(10) Patent No.: US 11,663,854 B2
(45) Date of Patent: May 30, 2023

(54) TIMING SYSTEMS INCLUDING TILTING SWITCHES

(71) Applicant: Tomislav Lakovic, Portland, OR (US)

(72) Inventor: Tomislav Lakovic, Portland, OR (US)

( * ) Notice: Subject to any disclaimer, the term of this patent is extended or adjusted under 35 U.S.C. 154(b) by 179 days.

(21) Appl. No.: 17/060,478

(22) Filed: Oct. 1, 2020

(65) Prior Publication Data

US 2022/0108563 A1 Apr. 7, 2022

(51) Int. Cl.

| | |
|---|---|
| ***G04F 10/00*** | (2006.01) |
| ***G07C 1/28*** | (2006.01) |
| ***A63F 3/00*** | (2006.01) |

(52) U.S. Cl.

CPC ..... *G07C 1/28* (2013.01); *A63F 3/00895* (2013.01); *G04F 10/00* (2013.01)

(58) Field of Classification Search

CPC ..... G04F 10/00; A63F 3/00895; A63F 3/02; G07C 1/28; G04B 37/0454; G04B 37/0427

See application file for complete search history.

(56) References Cited

U.S. PATENT DOCUMENTS 3,845,883 A * 11/1974 Johnson ..... G01F 13/006 222/30
4,362,393 A * 12/1982 Tissot ..... G04F 8/00 968/447
2003/0031092 A1* 2/2003 Hight ..... G04F 10/00 368/10
2004/0145114 A1* 7/2004 Ippolito ..... G04F 10/00 368/96
2005/0243655 A1* 11/2005 McCutcheon ..... G04F 10/00 368/107
2005/0276164 A1* 12/2005 Amron ..... G04C 3/002 368/82
2012/0307599 A1* 12/2012 Balter ..... G04F 8/006 368/107
2013/0058197 A1* 3/2013 Yonekura ..... G04G 21/04 368/10

* cited by examiner

*Primary Examiner* — Sean Kayes
(74) *Attorney, Agent, or Firm* — Mohr IP Law Solutions, PC

(57) ABSTRACT

Timing systems configured to be used with a computing device including an electronic display and a tilt sensor. The timing systems include a switch and computer executable instructions. The switch includes a base and a cradle. The cradle is pivotally mounted to the base and configured to support the computing device. The cradle is configured to pivot relative to the base between a first pivot position and a second pivot position. The computer executable instructions are stored on the computing device and include instructions for displaying a game timer on the electronic display of the computing device. The instructions include controlling the game timer in response to the tilt sensor detecting that the cradle has pivoted between the first pivot position and the second pivot position.

20 Claims, 8 Drawing Sheets

TIMING SYSTEMS INCLUDING TILTING SWITCHES

BACKGROUND

The present disclosure relates generally to timing systems. In particular, timing systems including tilting switches are described.

Timing systems are used to keep track of elapsed time and/or time remaining for a given event. One popular application of timing systems is in game applications. For example, games of chess are often timed with each player having a limited amount of time to complete his or her moves. Timing systems in the form of chess timers are used to keep track of the time available for each players' moves.

Known timing systems are not entirely satisfactory. For example, existing timing systems are not intuitive to use. Conventional chess timers provide user interfaces limited to physical buttons with complicated methods to adjust timer settings. Manuals for operating existing chess clocks can be over a hundred pages, which is undesirably complex for the relatively simple objective of setting time limits and time addition increments.

Conventional chess timers with wind-up mechanical mechanisms lack electronics and are not able to provide more sophisticated timing features and displays. Existing chess timers with electronics generally rely on non-rechargeable batteries, which limits their appeal. For example, timers that rely on non-rechargeable batteries are prone to the batteries becoming depleted at inopportune times. A user may not have replacement batteries on hand when the batteries deplete and properly disposing of depleted batteries may be a hassle.

Known software-based chess clocks embodied on smart phones and the like are less than ideal for a number of reasons. For example, conventional software-based chess clocks require users to tap the screen of a smartphone in defined regions. The defined regions generally must be visually identified, which means that players must shift attention away from the chess board to look at the smartphone screen, which disrupts concentration and wastes valuable time in a fast moving game.

Further, players often prefer to press a timer button with a chess piece they are holding rather than with their finger. Sometimes players press timer buttons with a chess piece with significant force. Touchscreens may not register a touch from a chess piece and may be damaged by a sharp impact of a chess piece.

Another limitation of conventional software chess clocks is that players must utilize a single smartphone to operate them. Hygiene concerns and the potential to spread germs and viruses by touching common surfaces make two people operating a software application on a shared device undesirable. Moreover, two players pressing virtual buttons on a screen tends to shift the position of the device. Over the course of a game, the device may be moved out of convenient reach for one or both players and/or may fall off the table or other surface on which it was placed.

Thus, there exists a need for timing systems that improve upon and advance the design of known timing systems. Examples of new and useful timing systems relevant to the needs existing in the field are discussed below.

SUMMARY

The present disclosure is directed to timing systems configured to be used with a computing device including an electronic display and a tilt sensor. The timing systems include a switch and computer executable instructions. The switch includes a base and a cradle. The cradle is pivotally mounted to the base and configured to support the computing device. The cradle is configured to pivot relative to the base between a first pivot position and a second pivot position. The computer executable instructions are stored on the computing device and include instructions for displaying a game timer on the electronic display of the computing device. The instructions include controlling the game timer in response to the tilt sensor detecting that the cradle has pivoted between the first pivot position and the second pivot position.

DETAILED DESCRIPTION

Figure 1:
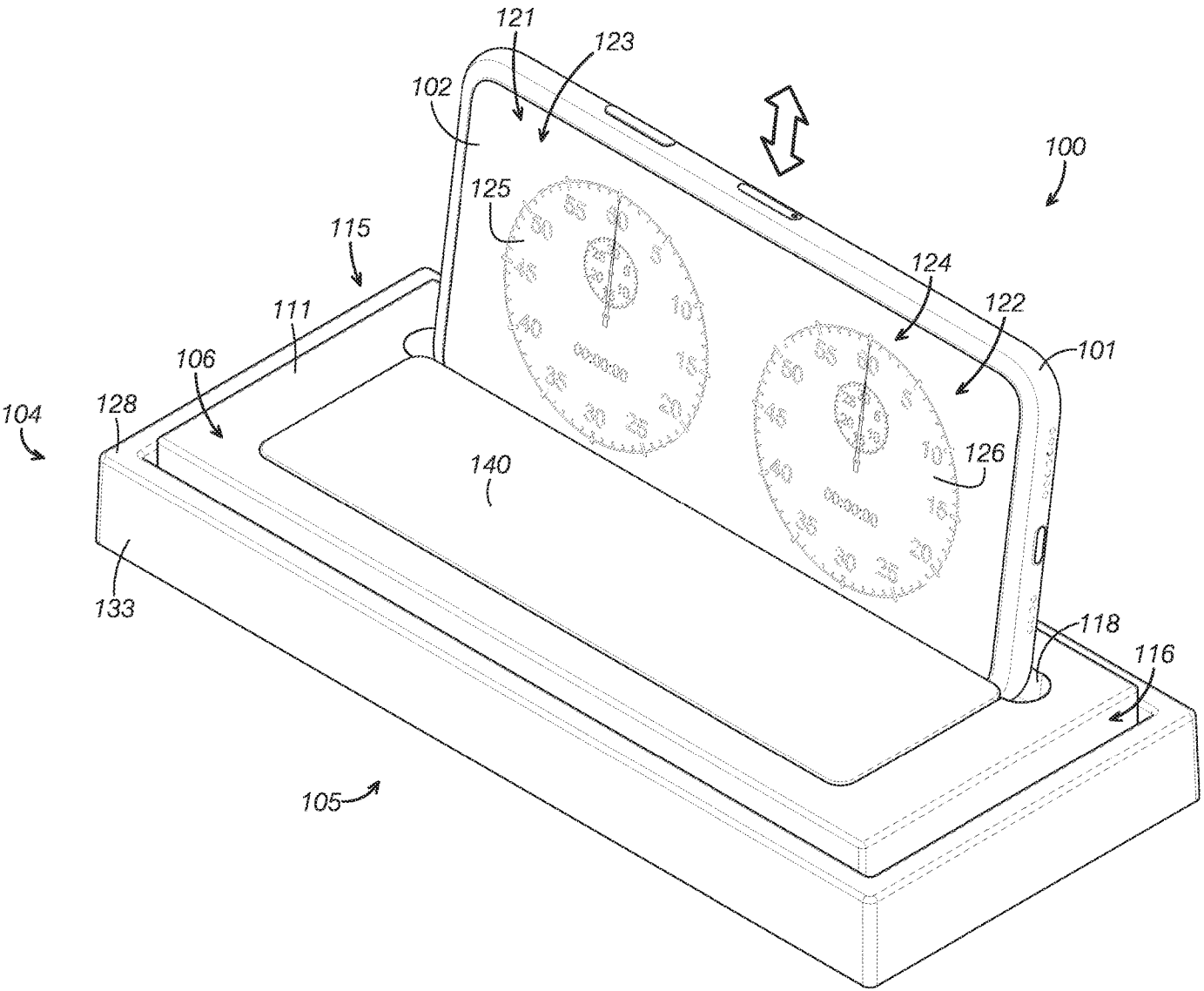
FIG. 1 is a perspective view of a first embodiment of a timing system supporting a smart phone on a cradle, the computing device is displaying a first clock and a second clock.

The disclosed timing systems will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various timing systems are provided. Related features in the examples may be identical, similar, or dissimilar in different examples. For the sake of brevity, related features will not be redundant explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

Timing Systems Including Tilting Switches

With reference to the figures, timing systems including tilting switches will now be described. The timing systems discussed herein function to keep track of how much time has elapsed between selected inputs. In game play scenarios, the timing systems function to keen track of a given players' time spent making his or her gameplay moves. Additionally or alternatively, the timing systems may keep track of and display a player's remaining time available for gameplay moves. In some examples, the timing systems add predetermined increments of time after each move the player makes.

The reader will appreciate from the figures and description below that the presently disclosed timing systems address many of the shortcomings of conventional timing systems. For example, the timing systems described herein are much more intuitive to use than conventional timing systems. Unlike conventional chess timers with user interfaces limited to physical buttons with complicated methods to adjust timer settings, the timing systems described in this document utilize intuitive software-based setting adjustments via touchscreen inputs. The timing systems disclosed herein do not require operating manuals to use and are perceived as simple and intuitive to anyone familiar with operating smartphone devices.

The presently disclosed timing systems incorporate sophisticated electronic timing features and displays without needing to be plugged and while utilizing rechargeable batteries. By not needing to be plugged in, the timing systems disclosed herein are not limited to locations where mains power is available. Instead, they may be used in a variety of locations, such as for games of chess outside in a park. The timing systems discussed herein are less prone to batteries becoming depleted at inopportune times because most people maintain adequate energy reserves in their computing devices with rechargeable batteries or means to recharge them are readily available. Unlike with conventional timing systems, a user need not have replacement batteries on hand to address situations when non-rechargeable batteries deplete and does not need to hassle with properly disposing depleted batteries.

Improving over conventional software application chess clocks, the presently disclosed timing systems do not require users to tap the screen of a smartphone in defined regions. Instead, the timing systems described in this document provide physical inputs that can be easily operated without looking at them. Thus, the presently described timing systems allow players to keep their attention focused on a game play board, which helps maintain concentration and saves valuable time in a fast-moving game.

The timing systems described in this document accommodate players activating the timing system with a chess piece they are holding rather than limiting them to using their finger. The timing system components are robust enough to accommodate vigorous impacts with chess pieces without damage and without impacting a valuable computing device.

The presently described timing systems avoid the drawbacks associated with players needing to utilize a single smartphone. The timing systems described herein are more hygienic and reduce the potential to spread germs and viruses by touching common surfaces of a shared computing device. Moreover, the timing systems described in this document are configured to remain in position when operated unlike conventional timing systems embodied on smart phones, which often move out of convenient reach for one or both players and/or may fall off the table.

Timing System

With reference to FIGS. 1-7, a timing system 100 will now be described as a first example of a timing system. The reader can see in FIGS. 1-7 that timing system 100 includes a switch 104 and computer executable instructions 109. In other examples, the timing system includes fewer components than depicted in the figures. In certain examples, the timing system includes additional or alternative components than depicted in the figures.

As shown in FIGS. 1-7, timing system 100 is configured to be used with a computing device 101. In some examples, the timing system includes the computing device. For example, with reference to FIG. 8, a timing system 200 includes a computing device 201 integrated with a switch 204. In other examples, the timing system includes a computing device in the form of a handheld computing device as shown in FIGS. 1-7.

The shape of the timing system may be adapted to be different than the specific examples shown in the figures to suit a given application. The size of the timing system may be varied as needed for a given application. In some examples, the timing system is larger relative to the other components than depicted in the figures.

Switch

The role of switch 104 is to selectively tilt computing device 101 to selectively start and stop a game timer 110. With reference to FIGS. 1-5, switch 104 includes a base 105 and a cradle 106. As depicted in FIGS. 1-7, switch 104 is configured to support computing device 101.

In the present example, switch 104 is operable to charge a rechargeable battery of computing device 101. Switch 104 includes a power cord 151 and wireless charging circuitry 152 electrically coupled to power cord 151. Wireless charging circuitry 152 is depicted representatively in FIG. 6 within cradle 106.

The shape of the switch may be adapted to be different than the specific examples shown in the figures to suit a given application. For example, the switch may include a face having the shape of a regular or irregular polygon, such as a circle, oval, triangle, square, rectangle pentagon, and the like. Additionally or alternatively, the switch may include a face having an irregular shape. In three dimensions, the shape of the switch may be a sphere, a pyramid, a cone, a cube, and variations thereof, such as a hemisphere or a frusto-conical shape.

The size of the switch may be varied as needed for a given application. In some examples, the switch is larger relative to the other components than depicted in the figures. In other examples, the switch is smaller relative to the other components than depicted in the figures. Further, the reader should understand that the switch and the other components may all be larger or smaller than described herein while maintaining their relative proportions.

In the present example switch 104 is composed primarily of plastic. However, the switch may be composed of any currently known or later developed material suitable for the applications described herein for which it is used. Suitable materials include metals, polymers, ceramics, wood, and composite materials.

Base

Base 105 functions to support other components of timing system 100, including cradle 106. The reader can see in FIGS. 1-7 that base 105 includes four sidewalls 133 and a floor 134. The sidewalls terminate at a top level 128 and define a cavity 129.

Cavity 129 is complementarily configured with cradle 106. As shown in FIGS. 1-7, cavity 129 is configured to receive cradle 106 with a majority of cradle 106 disposed below top level 128 of sidewalls 133. The reader can see in FIGS. 1-3 that cradle pivots within cavity 129.

Figure 4:
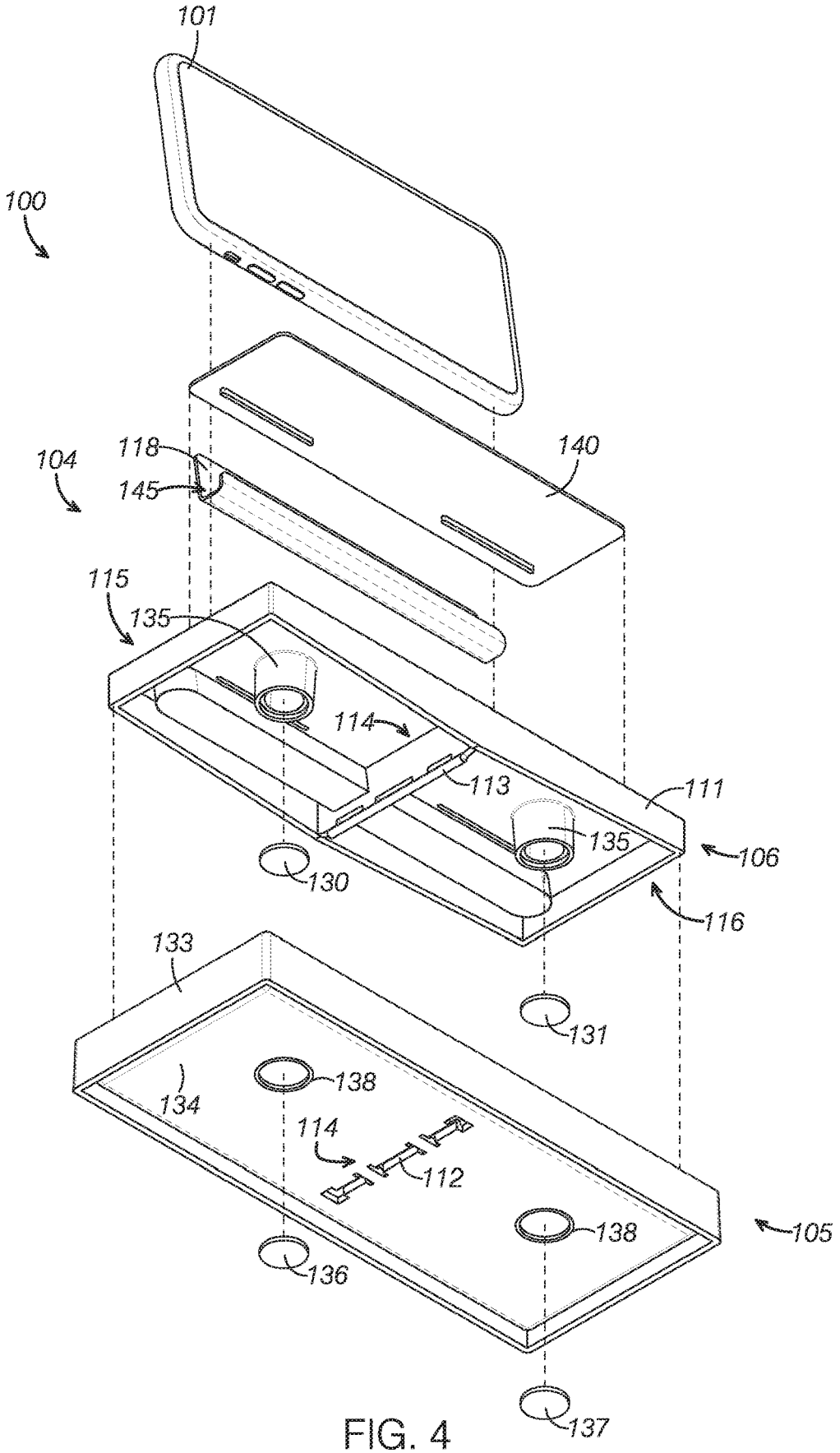
FIG. 4 is an exploded view of the timing system shown FIG. 1 from a bottom front left perspective.
Figure 5:
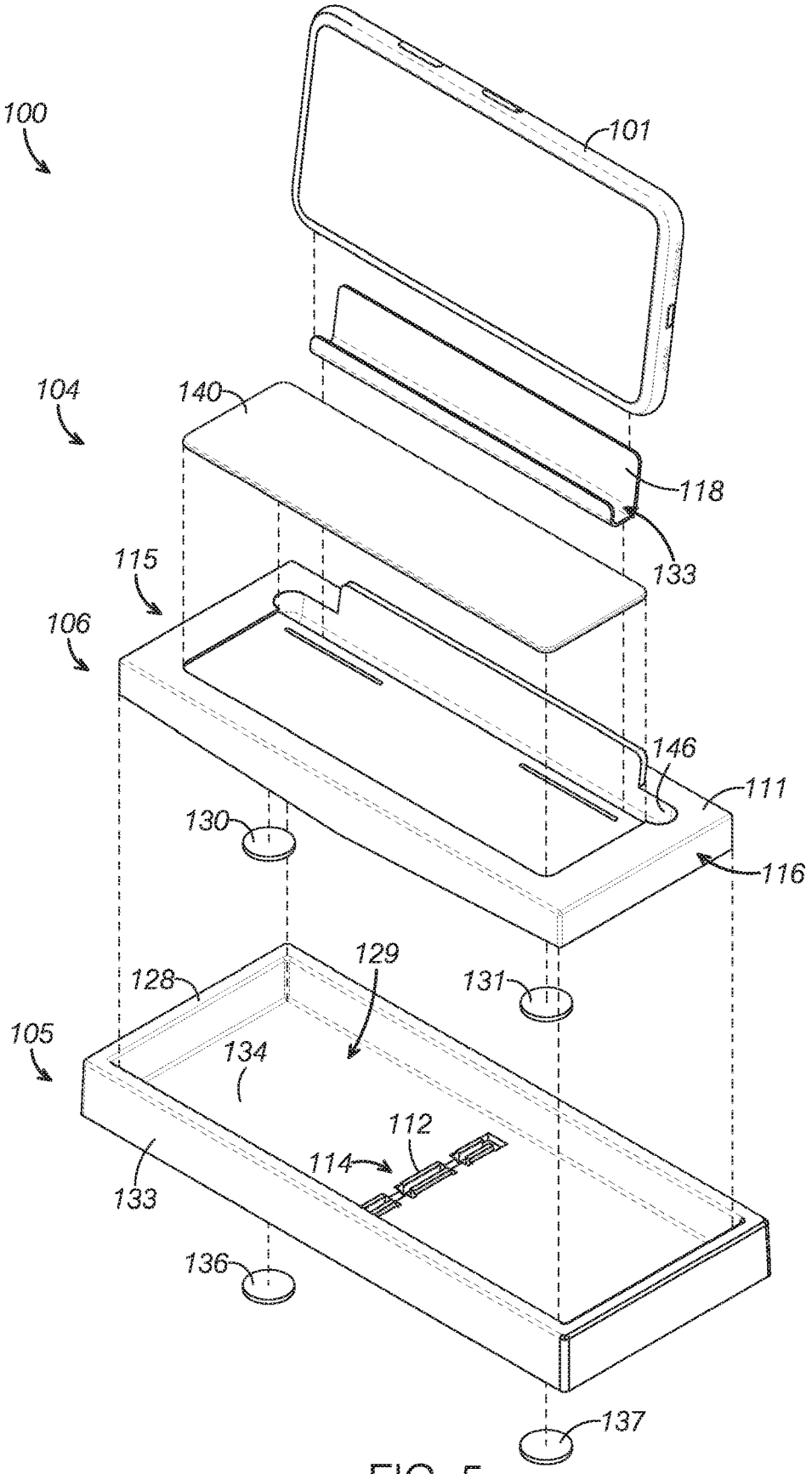
FIG. 5 is an exploded view of the timing system shown in FIG. 1 from a top front right perspective.

As shown in FIGS. 4 and 5, base 105 includes a pivot bearing 112 formed in floor 134. Base 105 also defines two magnet wells 135 to receive a third magnet 136 and a fourth magnet 137. Magnet wells 135 are positioned to underlie magnet wells 138 formed in cradle 106.

As depicted in FIGS. 4 and 5, pivot bearing 112 cooperates with a pivot shaft 113 of cradle 106 to define a pivot assembly 114. With reference to FIGS. 1-5, the reader can see that pivot bearing 112, and therefore pivot assembly 114, extends along the longitudinal midline of base 105 and platform 111. The longitudinal midline is defined as a line extending perpendicular to the longitudinal dimension of base 105 at the approximate middle of the longitudinal dimension of base 105.

The size of the base may be varied as needed for a given application. In some examples, the base is larger relative to the other components than depicted in the figures. In other examples, the base is smaller relative to the other components than depicted in the figures. Further, the reader should understand that the base and the other components may all be larger or smaller than described herein while maintaining their relative proportions.

In the present example base 105 is composed of plastic. However, the base may be composed of any currently known or later developed material suitable for the applications described herein for which it is used. Suitable materials include metals, polymers, ceramics, wood, and composite materials.

The shape of the base may be adapted to be different than the specific examples shown in the figures to suit a given application. For example, the base may include a face having the shape of a regular or irregular polygon, such as a circle, oval, triangle, square, rectangle pentagon, and the like. Additionally or alternatively, the base may include a face having an irregular shape. In three dimensions, the shape of the base may be a sphere, a pyramid, a cone, a cube, and variations thereof, such as a hemisphere or a frusto-conical shape.

Cradle

Cradle 106 serves to support computing device 101 and to selectively pivot to control operation of game timer 110 operating on computing device 101. As shown in FIG. 1-5, cradle 106 includes a platform 111 pivotally mounted to base 105 and a device mount 118 secured to platform 111. As depicted in FIGS. 4 and 5, cradle 106 also includes a first magnet 130, a second magnet 131, and a lid 140.

Figure 2:
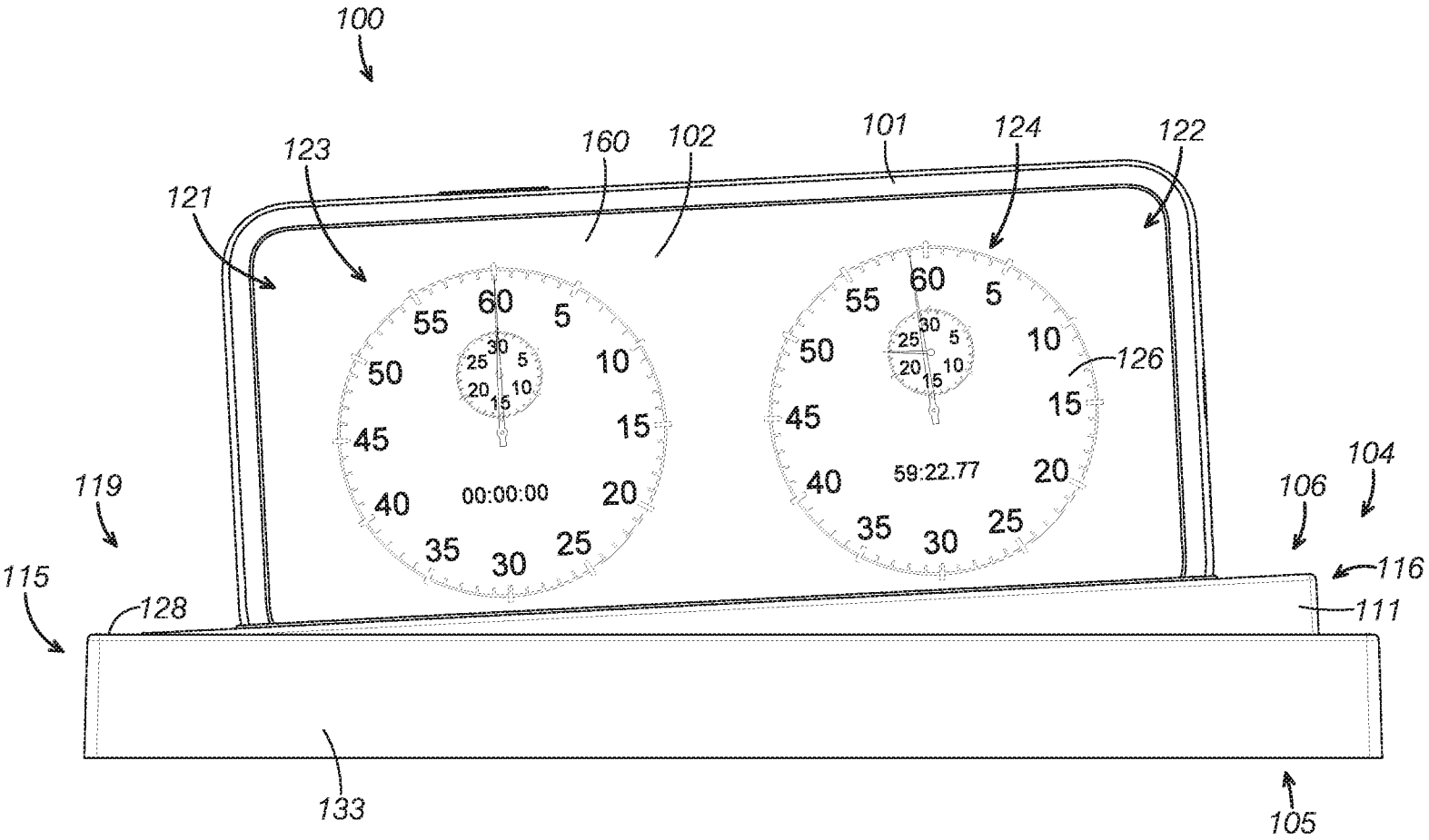
FIG. 2 is a front elevation view of the timing system shown in FIG. 1 with the cradle in a first pivot position inclined from left to right in the figure, the first clock on the left of the figure remaining static while the second clock runs.
Figure 3:
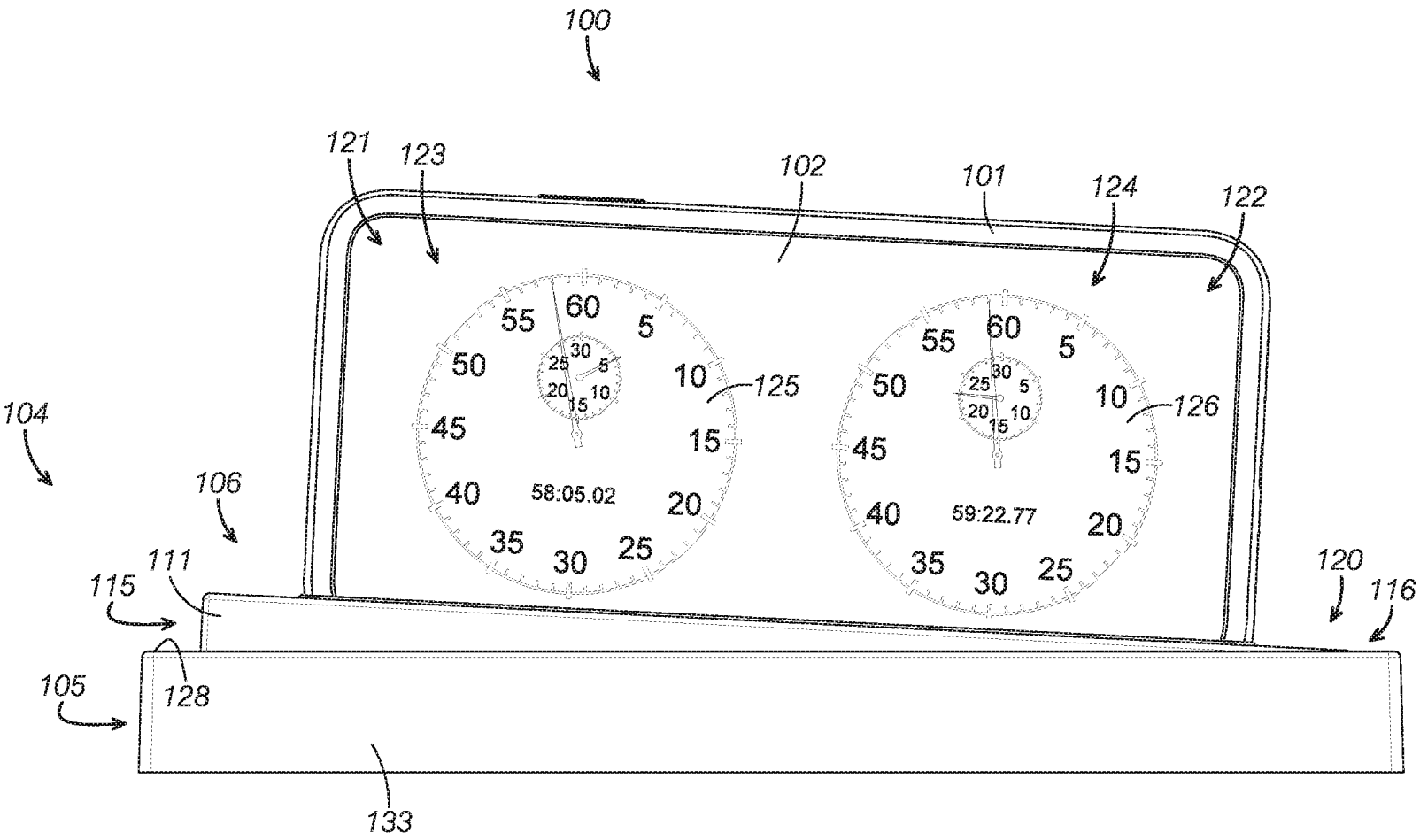
FIG. 3 is a front elevation view of the timing system shown in FIG. 1 with the cradle in a first pivot position declined from left to right in the figure, the first clock on the left of the figure running while the second clock remains static.

With reference to FIGS. 1-3, cradle 106 is configured to pivot relative to base 105 between a first pivot position 107 and a second pivot position 108. As depicted in FIGS. 1-3, cradle 106 is configured to support the computing device. Thus, computing device 101 tilts in turn with cradle 106 as cradle 106 pivots between first pivot position 107 and second pivot position 108. Computing device 101 tilting as cradle 106 pivots activates tilt sensor 103 and triggers game timer 110 instructions in computer executable instruction 109.

The shape of the cradle may be adapted to be different than the specific examples shown in the figures to suit a given application. For example, the cradle may include a face having the shape of a regular or irregular polygon, such as a circle, oval, triangle, square, rectangle pentagon, and the like. Additionally or alternatively, the cradle may include a face having an irregular shape. In three dimensions, the shape of the cradle may be a sphere, a pyramid, a cone, a cube, and variations thereof, such as a hemisphere or a frusto-conical shape.

In the present example cradle 106 is composed primarily of plastic. However, the cradle may be composed of any currently known or later developed material suitable for the applications described herein for which it is used. Suitable materials include metals, polymers, ceramics, wood, and composite materials.

The size of the cradle may be varied as needed for a given application. In some examples, the cradle is larger relative to the other components than depicted in the figures. In other examples, the cradle is smaller relative to the other components than depicted in the figures. Further, the reader should understand that the cradle and the other components may all be larger or smaller than described herein while maintaining their relative proportions.

Platform

Platform 111 serves to support other components of cradle 106, including device mount 118, first magnet 130, second magnet 131, and lid 140. To support device mount 118, platform 111 defines a depression 146 complementarily configured with device mount 118 such that device mount 118 may be inserted into depression 146.

To support first magnet 130 and second magnet 131, platform 111 defines two magnet wells 138. Magnet wells 138 are configured to receive a first magnet 130 and second magnet 131. Magnet wells 138 are positioned to overlie magnet wells 135 formed in base 105.

As shown in FIGS. 1-6, platform 111 extends longitudinally between a first end 115 and a second end 116 opposite first end 115. The reader can see in FIGS. 1-5 that platform 111 defines a longitudinal midline halfway between first end 115 and second end 116. As depicted in FIG. 2, first end 115 of platform 111 is at a lower height than second end 116 of platform 111 in first pivot position 107. With reference to FIG. 3, second end 116 of platform 111 is at a lower height than first end 115 of platform 111 in second pivot position 108.

Figure 6:
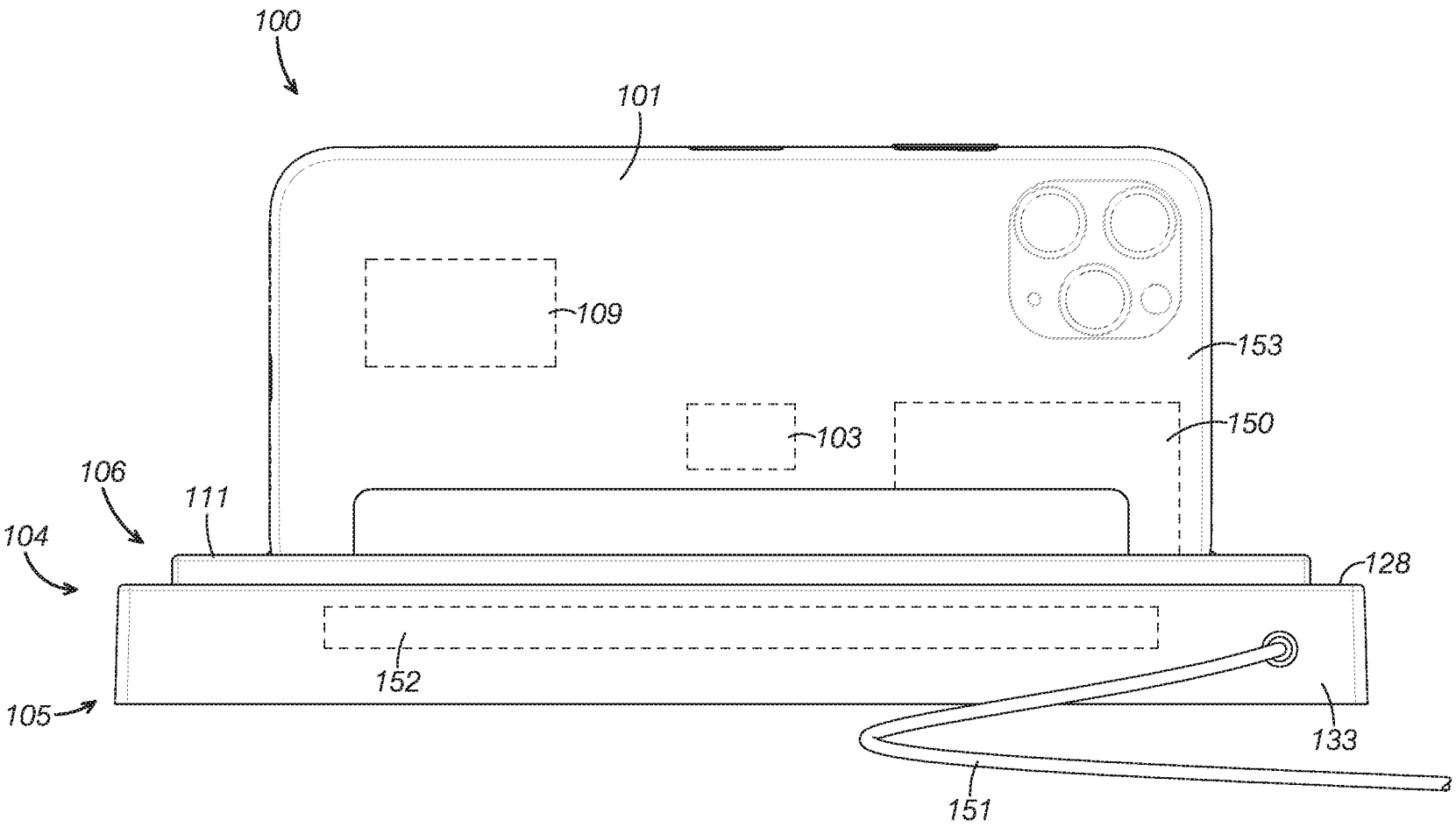
FIG. 6 is a right side elevation view of the timing system shown in FIG. 1 depicting the smart phone supported in an upright position on the cradle so that the display is visible.
Figure 7:
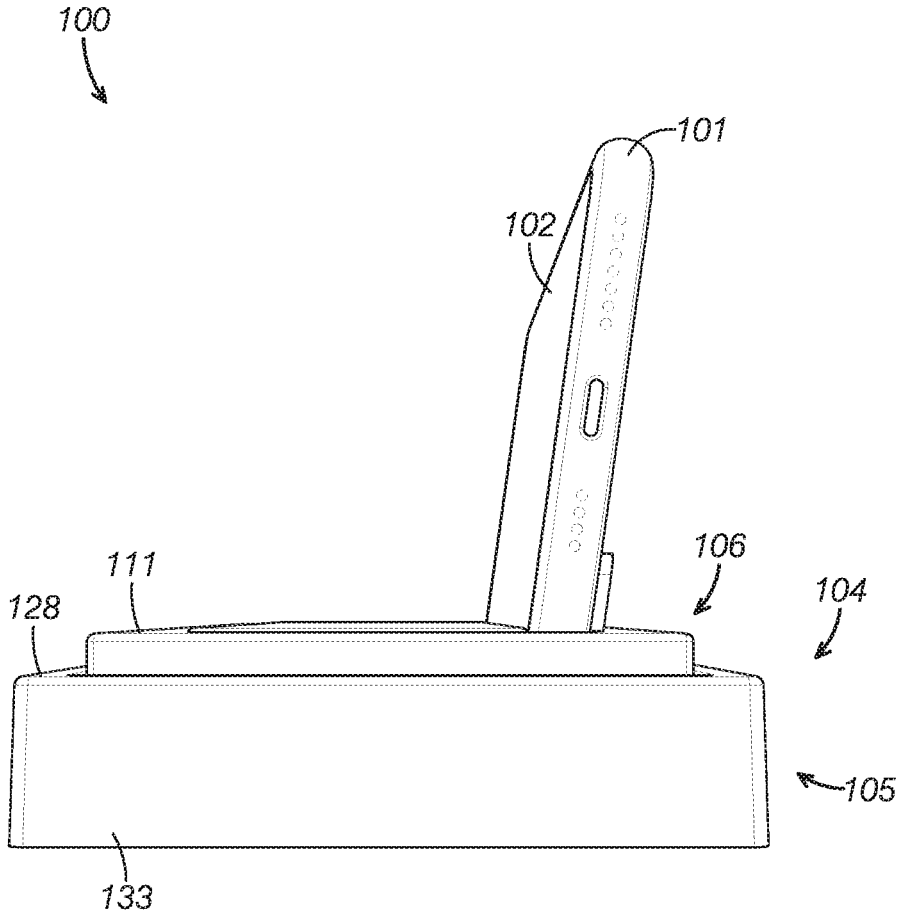
FIG. 7 is a rear elevation view of the timing system shown FIG. 1 depicting a power cord extending from the base.

As shown FIGS. 4-6, depression 146 extends longitudinally towards first end 115 of platform 111 and second end 116 of platform 111. The reader can see in FIGS. 4-6 that depression 146 is longitudinally centered on the longitudinal midline of platform 111.

With reference to FIG. 4, platform 111 includes a pivot shaft 113 complementarily configured with pivot bearing 112. Pivot shaft 113 extends along the longitudinal midline of platform 111. As depicted in FIGS. 4 and 5, pivot shaft 113 cooperates with pivot bearing 112 of base 105 to define pivot assembly 114.

As depicted in FIGS. 1-7, platform 111 is disposed substantially within cavity 129. However, lid 140 and edges of platform 111 extend above top level 128 of cavity 129 to make it easier for users to press on cradle 106 to pivot it between first pivot position 107 and second pivot position 108.

The size of the platform may be varied as needed for a given application. In some examples, the platform is larger relative to the other components than depicted in the figures. In other examples, the platform is smaller relative to the other components than depicted in the figures. Further, the reader should understand that the platform and the other components may all be larger or smaller than described herein while maintaining their relative proportions.

In the present example platform 111 is composed of plastic. However, the platform may be composed of any currently known or later developed material suitable for the applications described herein for which it is used. Suitable materials include metals, polymers, ceramics, wood, and composite materials.

Device Mount

As can be seen in FIGS. 4-7, device mount 118 is configured to support computing device 101 on pivoting platform 111. The reader can see in FIGS. 4-7 that device mount 118 defines a channel 145 in which computing device 101 may be inserted.

Device mount 118 inserts into depression 146 of platform 111. As shown in FIGS. 4-6, device mount 118 extends longitudinally towards first end 115 of platform 111 and second end 116 of platform 111. The reader can see in FIGS. 4-6 that device mount 118 is longitudinally centered on the longitudinal midline of platform 111.

The size of the device mount may be varied as needed for a given application. In some examples, the device mount is larger relative to the other components than depicted in the figures. In other examples, the device mount is smaller relative to the other components than depicted in the figures. Further, the reader should understand that the device mount and the other components may all be larger or smaller than described herein while maintaining their relative proportions.

The shape of the device mount may be adapted to be different than the specific examples shown in the figures to suit a given application. For example, the device mount may include a face having the shape of a regular or irregular polygon, such as a circle, oval, triangle, square, rectangle pentagon, and the like. Additionally or alternatively, the device mount may include a face having an irregular shape.

The device mount may be any currently known or later developed type of device mount, such as those commonly used for phone charging devices. The reader will appreciate that a variety of device mount types exist and could be used in place of the device mount shown in the figures. In addition to the types of device mounts existing currently, it is contemplated that the timing systems described herein could incorporate new types of device mounts developed in the future.

Pivot Assembly

The role of pivot assembly 114 is to allow cradle 106 to pivot relative to base 105. Pivot assembly 114 also allows computing device 101 to tilt between tilt positions as cradle 106 pivots relative to base 105.

As depicted in FIGS. 4 and 5, pivot assembly 114 is collectively defined by, pivot shaft 113 and pivot bearing 112. With reference to FIGS. 1-5, pivot assembly 114 extends along the longitudinal midline of platform 111.

The pivot assembly may be any currently known or later developed type of pivot assembly. The reader will appreciate that a variety of pivot assembly types exist and could be used in place of the pivot assembly shown in the figures. In addition to the types of pivot assemblies existing currently, it is contemplated that the timing systems described herein could incorporate new types of pivot assemblies developed in the future.

The size of the pivot assembly may be varied as needed for a given application. In some examples, the pivot assembly is larger relative to the other components than depicted in the figures. In other examples, the pivot assembly is smaller relative to the other components than depicted in the figures. Further, the reader should understand that the pivot assembly and the other components may all be larger or smaller than described herein while maintaining their relative proportions.

Magnets

First magnet 130 and second magnet 131 serves to magnetically couple with third magnet 136 and fourth magnet 137, respectively. The magnets magnetically coupling helps to maintain cradle 106 in a selected position, such as first pivot position 107 or second pivot position 108. However, the reader should understand that magnets in the timing system are optional. The timing system may operate effectively without magnets with the cradle maintaining a selected position due to a combination of friction and gravity or other means.

In some examples, the timing system utilizes two magnets instead of four as depicted in the figures. In examples with two magnets, the magnets magnetically couple to a magnetically attractable material, such as metal, formed in the base and/or cradle, rather than magnetically coupling to other magnets.

With reference to FIGS. 4 and 5, first magnet 130 is configured to magnetically couple with third magnet 136 of base 105 when cradle 106 is in first pivot position 107. As depicted to FIGS. 4 and 5, second magnet 131 is configured to magnetically couple with fourth magnet 137 of base 105 when cradle 106 is in second pivot position 108.

As shown in FIGS. 4 and 5, first magnet 130 is mounted to platform 111 between the longitudinal midline and first end 115. The reader can see in FIGS. 4 and 5 that second magnet 131 is mounted to platform 111 between the longitudinal midline and second end 116.

The number of magnets in the timing system may be selected to meet the needs of a given application. The reader should understand that the number of first magnets may be different in other examples than is shown in the figures. For instance, some timing system examples include additional or fewer first magnets than described in the present example.

The size of the magnets may be varied as needed for a given application. In some examples, the magnets are larger relative to the other components than depicted in the figures. In other examples, the magnets are smaller relative to the other components than depicted in the figures. Further, the reader should understand that the magnets and the other components may all be larger or smaller than described herein while maintaining their relative proportions.

The magnets may be any currently known or later developed type of magnet. The reader will appreciate that a variety of magnet types exist and could be used in place of the magnets shown in the figures. In addition to the types of magnets existing currently, it is contemplated that the timing systems described herein could incorporate new types of magnets developed in the future.

Computing Device

Computing device 101 functions to execute computer executable instructions 109 to keep track of time metrics in coordination with switch 104. Computing device 101 further functions display a game timer 110 to users.

As depicted in FIGS. 1-3 and FIG. 6, computing device 101 includes an electronic display 102 and a tilt sensor 103. In the present example, computing device 101 includes a rechargeable battery 150 mounted inside a housing 153. The rechargeable battery may be any currently known or later developed type of rechargeable battery.

In the present example, computing device 101 is a smartphone. However, the computing device may be any currently known or later developed type computing device. The reader will appreciate that a variety of computing device types exist and could be used in place of the computing device shown in the figures. In addition to the types of computing devices existing currently, it is contemplated that the timing systems described herein could incorporate new types of computing devices developed in the future.

As shown in FIGS. 2 and 3, computing device 101 tilts between a first tilt position 119 and a second tilt position 120 when supported on device mount 118 and as cradle 106 pivots between first pivot position 107 and second pivot position 108, respectively. Computing device 101 tilting as cradle 106 pivots activates tilt sensor 103 and triggers game timer 110 instructions in computer executable instructions 109. As depicted in FIGS. 1-5 and 7, cradle 106 supports computing device 101 in a position 132 where the plane of the planar display surface is transverse to the axis of rotation on which cradle 106 pivots.

The size of the computing device may be varied as needed for a given application. In some examples, the computing device is larger relative to the other components than depicted in the figures. In other examples, the computing device is smaller relative to the other components than depicted in the figures. Further, the reader should understand that the computing device and the other components may all be larger or smaller than described herein while maintaining their relative proportions.

The shape of the computing device may be adapted to be different than the specific examples shown in the figures to suit a given application.

Electronic Display

Electronic display 102 serves to display information to users via an illuminated screen. The reader can see in FIGS. 1-5 and 7 that electronic display 102 of computing device 101 includes a planar display surface 160, which is an illuminated screen.

As shown in FIGS. 1-3, electronic display 102 includes a first portion 121 proximate first end 115 of platform 111 when computing device 101 is mounted on device mount 118. With continued reference to FIGS. 1-3, the reader can see that electronic display 102 includes a second portion 122 proximate second end 116 of platform 111 when computing device 101 is mounted on device mount 118.

The electronic display may be any currently known or later developed type of electronic display. The reader will appreciate that a variety of electronic display types exist and could be used in place of the electronic display shown in the figures. In addition to the types of electronic displays existing currently, it is contemplated that the timing systems described herein could incorporate new types of electronic displays developed in the future.

Tilt Sensor

Tilt sensor 103 operates to detect when computing device 101 is tilted. In the present example, tilt sensor 103 is configured to detect when computing device 101 tilts in any direction in three dimensions, such as about a horizontal axis, about a vertical axis, or about an axis perpendicular to the horizontal and vertical axes. In use, tilt sensor 103 detects when computing device 101 is tilted to first tilt position 119 and second tilt position 120 as cradle 106 pivots between first pivot position 107 and second pivot position 108, respectively. Computer executable instructions 109 utilize tilt position data received from tilt sensor 103 to control game timer 110.

The tilt sensor may be any currently known or later developed type of electronic display. The reader will appreciate that a variety of electronic display types exist and could be used in place of the electronic display shown in the figures. In addition to the types of electronic displays existing currently, it is contemplated that the timing systems described herein could incorporate new types of electronic displays developed in the future.

Computer Executable Instructions

The role of computer executable instructions 109 is to provide instructions for computing device 101 to keep track of time metrics in coordination with switch 104. Further, computer executable instructions 109 function to display game timer 110 on electronic display 102 of computing device 101.

In the present example, as depicted representatively in FIG. 6, computer executable instructions 109 are stored on computing device 101 after downloading them from an online server, such as the Google Play Store or the Apple App Store. However, in some examples the computer executable instructions are stored independent from the computing device and the computing device remotely accesses the instructions. For example, the computer executable instructions may be stored on a memory module mounted to the switch, such as inside the switch, and the computing device may be in wired or wireless data communication with the memory module storing the instructions. In other examples, the instructions are stored on a server and the computing device accesses the instructions via a data network.

Computer executable instructions 109 provide instructions for starting and stopping game clocks 125 and 126 in response to cradle 106 tilting computing device 101. As shown in FIGS. 1-3, computer executable instructions 109 are configured to start first clock 125 and to stop second clock 126 when cradle 106 is pivoted to second pivot position 108. With continued reference to FIGS. 1-3, computer executable instructions 109 are configured to start second clock 126 and to stop first clock 125 when cradle 106 is pivoted to first pivot position 107.

As depicted in FIGS. 1-3, computer executable instructions 109 are configured to add predetermined increment 127 of time to the second timer clock when cradle 106 is pivoted to second pivot position 108. Computer executable instructions 109 are configured to add a predetermined increment of time to first clock 125 when cradle 106 is pivoted to first pivot position 107.

Game Timer

Game timer 110 functions to keep track of and display time metrics to a user. The time metrics may include how much time has elapsed in a game, how much time remains in a game, how much time a player has available for a given turn, how much time will be added upon completion of a turn, and/or how much time a user took to complete a turn. A wide variety of other metrics or other details relevant to a given game, such as a score, number of pieces captured, and alarms or warnings, may also be displayed.

As depicted in FIGS. 1-3, game timer 110 is displayed on electronic display 102 of computing device 101. The reader can see in FIGS. 1-3 that game timer 110 is configured to display a first player display 123 in first portion 121 of electronic display 102. As shown in FIGS. 1-3, game timer 110 is configured to display a second player display 124 in second portion 122 of electronic display 102. In some examples, the game timer displays a single display rather than separate displays relevant to two different players. In other examples, more than two player displays are displayed.

With reference to FIGS. 1-3, game timer 110 is configured to selectively start and stop when computing device 101 tilts between first tilt position 119 and second tilt position 120. Users selectively cause computing device 101 to tilt between first tilt position 119 and second tilt position 120 by selectively causing cradle 106 to pivot between first pivot position 107 and second pivot position 108, respectively. The game timer may include visual cues to let the user know when it is running and/or stopped.

The size of the game timer may be varied as needed for a given application. In some examples, the game timer is larger relative to the other components than depicted in the figures. In other examples, the game timer is smaller relative to the other components than depicted in the figures. Further, the reader should understand that the game timer and the other components may all be larger or smaller than described herein while maintaining their relative proportions.

The number of game timers in the timing system may be selected to meet the needs of a given application. The reader should understand that the number of game timers may be different in other examples than is shown in the figures. For instance, some timing system examples include additional or fewer game timers than describe in present example.

The game timer may be any currently known or later developed type of game timer. The reader will appreciate that a variety of game timer types exist and could be used in place of the game timer shown in the figures. In addition to the types of game timers existing currently, it is contemplated that the timing systems described herein could incorporate new types of game timers developed in the future.

Player Displays

As shown in FIGS. 1-3, first player display 123 includes a first clock 125 simulating a running clock. The reader can see in FIGS. 1-3 that second player display 124 includes a second clock 126 simulating a running clock.

The style and formatting of the player displays may be different in different examples. For example, the player displays may display digital clocks primarily displaying numbers rather than an analog clock. In other examples, the player displays may include a graphic other than a clock representing time elapsed and/or time remaining.

Game Clocks

The game clocks may be any currently known or later developed type of clock configured to run on a computing device. The reader will appreciate that a variety of clock types and software programs exist and could be used in place of the clocks shown in the figures. In addition to the types of clocks existing currently, it is contemplated that the timing systems described herein could incorporate new types of clocks developed in the future.

Additional Embodiments

With reference to the figures not yet discussed, the discussion will now focus on additional timing system embodiments. The additional embodiments include many similar or identical features to timing system 100. Thus, for the sake of brevity, each feature of the additional embodiments below will not be redundantly explained. Rather, key distinctions between the additional embodiments and timing system 100 will be described in detail and the reader should reference the discussion above for features substantially similar between the different timing system examples.

Second Embodiment

Figure 8:
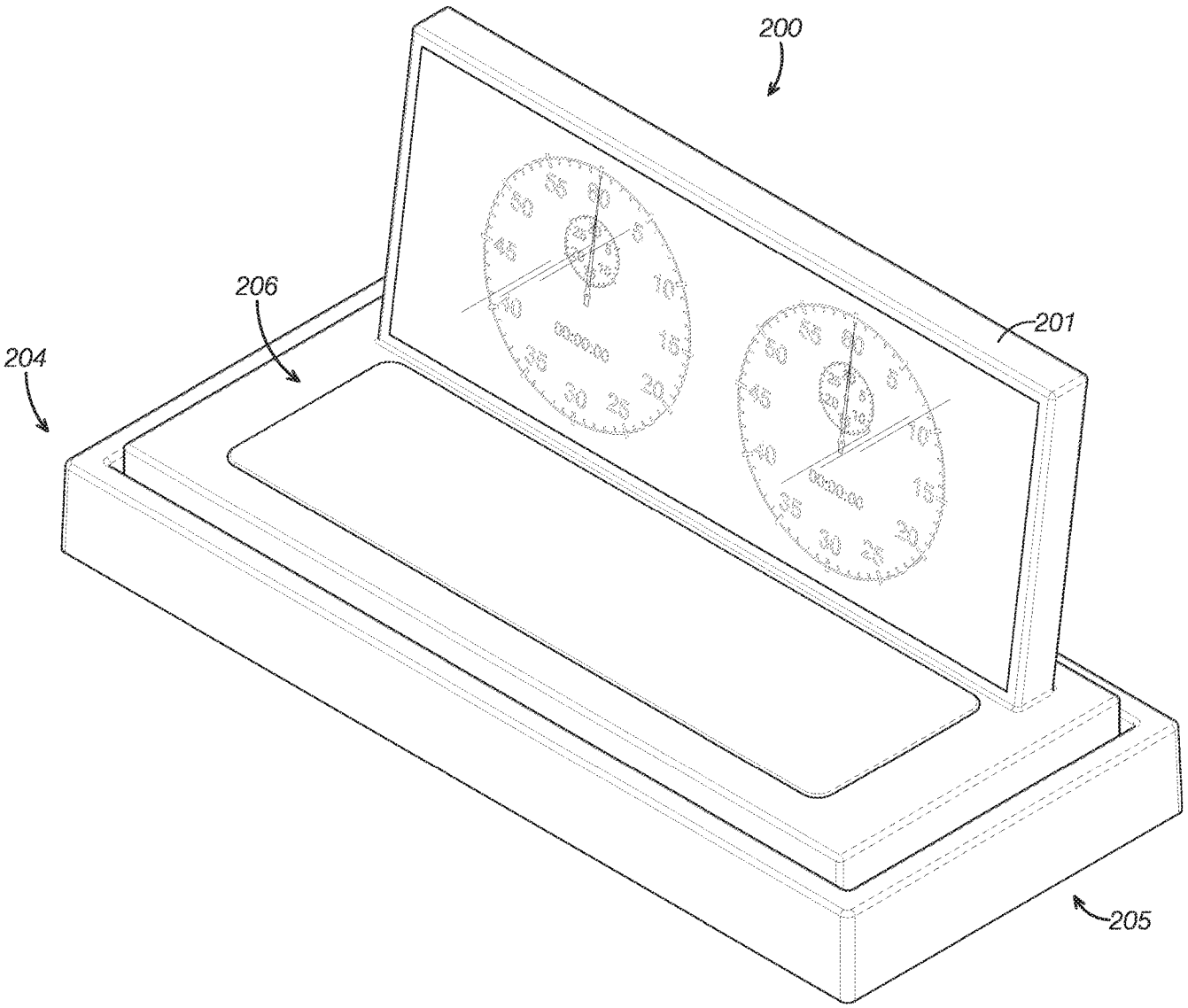
FIG. 8 is a perspective view of a second embodiment of a timing system, the timing system including a fixed electronic display integrated on the cradle instead of a removeable smartphone.

Turning attention to FIG. 8, a timing system 200 will now be described as a second example of a timing system. As can be seen in FIG. 8, timing system 200 includes a computing device 201, a switch 204 and computer executable instructions. Switch 204 includes a cradle 206 and a base 205.

A distinction between timing system 200 and timing system 100 is that computing device 201 is fixedly secured to a cradle 206 of switch 204 rather than a removable handheld device as with computing device 101. With computing device 201 being fixedly secured to switch 204, timing system 200 provides an integrated timing system that does not rely on users providing a handheld computing device. An integrated timing system may be desirable to reduce potential compatibility issues between computing devices and switches and/or to have more control over how the computer executable instructions are processed.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A timing system for use with a computing device including an electronic display and a tilt sensor, the timing system comprising:

a switch configured to support the computing device, the switch including:

a base; and a cradle pivotally mounted to the base, the cradle configured to support the computing device and to pivot relative to the base between a first pivot position and a second pivot position; and computer executable instructions stored on the computing device, the computer executable instructions configured to run a game timer on the computing device and to control the game timer in response to the tilt sensor detecting that the cradle has pivoted between the first pivot position and the second pivot position;

wherein the game timer is displayed on the electronic display of the computing device.

2. The timing system of claim 1, wherein the computing device is a smartphone.

3. The timing system of claim 1, wherein the cradle includes a platform pivotally mounted to the base.

4. The timing system of claim 3, wherein:

the base includes a pivot bearing;

the platform includes a pivot shaft complementarily configured with the pivot bearing; and the pivot shaft and the pivot bearing collectively define a pivot assembly.

5. The timing system of claim 4, wherein:

the platform extends longitudinally between a first end and a second end opposite the first end;

the platform defines a longitudinal midline halfway between the first end and the second end; and the pivot assembly extends along the longitudinal midline of the platform.

6. The timing system of claim 5, wherein:

the first end of the platform is at a lower height than the second end of the platform in the first pivot position; and the second end of the platform is at a lower height than the first end of the platform in the second pivot position.

7. The timing system of claim 6, wherein:

the cradle includes a device mount secured to the platform; and the device mount is configured to support the computing device.

8. The timing system of claim 7, wherein the device mount extends longitudinally towards the first end of the platform and the second end of the platform.

9. The timing system of claim 8, wherein the device mount is longitudinally centered on the longitudinal midline of the platform.

10. The timing system of claim 9, wherein the computing device tilts between a first tilt position and a second tilt position when supported on the device mount and the cradle pivots between the first pivot position and the second pivot position, respectively.

11. The timing system of claim 10, wherein the game timer is configured to selectively start and stop when the computing device tilts between the first tilt position and the second tilt position.

12. The timing system of claim 10, wherein:

the electronic display of the computing device includes a first portion proximate the first end of the platform when the computing device is mounted on the device mount;

the electronic display of the computing device includes a second portion proximate the second end of the platform when the computing device is mounted on the device mount;

the game timer is configured to display a first player display in the first portion of the electronic display; and the game timer is configured to display a second player display in the second portion of the electronic display.

13. The timing system of claim 12, wherein:

the first player display includes a first clock simulating a running clock;

the second player display includes a second clock simulating a running clock.

14. The timing system of claim 13, wherein:

the computer executable instructions are configured to start the second clock and to stop the first clock when the cradle is pivoted to the first pivot position; and the computer executable instructions are configured to start the first clock and to stop the second clock when the cradle is pivoted to the second pivot position.

15. The timing system of claim 14, wherein:

the computer executable instructions are configured to add a predetermined increment of time to the first clock when the cradle is pivoted to the first pivot position; and the computer executable instructions are configured to add the predetermined increment of time to the second timer clock when the cradle is pivoted to the second pivot position.

16. The timing system of claim 5, wherein:

the base includes sidewalls that terminate at a top level and define a cavity; and the platform is disposed substantially within the cavity.

17. The timing system of claim 5, wherein the cradle includes:

a first magnet mounted to the platform between the longitudinal midline and the first end, the first magnet being configured to magnetically couple with the base when the cradle is in the first pivot position; and a second magnet mounted to the platform between the longitudinal midline and the second end, the second magnet being configured to magnetically couple with the base when the cradle is in the second pivot position.

18. The timing system of claim 1, wherein:

the computing device includes a rechargeable battery; and the switch is operable to charge the rechargeable battery.

19. The timing system of claim 1, further comprising the computing device, wherein the computing device is fixedly secured to the cradle.

20. The timing system of claim 1, wherein:

the electronic display of the computing device includes a planar display surface; and the cradle supports the computing device in a position where the plane of the planar display surface is transverse to the axis of rotation on which the cradle pivots.

* * * * *